US005122336A

United States Patent [19]

Roux et al.

[11] Patent Number: 5,122,336

[45] Date of Patent: Jun. 16, 1992

[54] HIGH HARDNESS STEEL FOR ARMOURING AND PROCESS FOR THE PRODUCTION OF SUCH A STEEL

[75] Inventors: Remi Roux, Le Creusot; Laurent Sangoy, Cergy Pontoise; J. Henri Leger, Montchanin, all of France

[73] Assignee: Creusot-Loire Industrie, Puteaux, France

[21] Appl. No.: 594,112

[22] Filed: Oct. 9, 1990

[30] Foreign Application Priority Data

Oct. 9, 1989 [FR] France ..... 89 13164

[51] Int. Cl.[5] ..... C22C 38/44; C22D 8/00

[52] U.S. Cl. ..... 420/108; 148/621; 148/335; 148/653

[58] Field of Search ..... 148/335, 12.4; 420/108

[56] References Cited

U.S. PATENT DOCUMENTS 2,170,727 8/1939 Mitchell ..... 420/108

3,152,020 10/1964 Gross ..... 148/335

OTHER PUBLICATIONS

Key to Steels, 10 Edition 1974, W. German.

*Primary Examiner*—Deborah Yee

*Attorney, Agent, or Firm*—Fay, Sharpe, Beall, Fagan, Minnich & McKee

[57] ABSTRACT

The invention relates to a high-hardness steel for armouring having the following chemical composition by weight: 0.4 to 0.7% of carbon, 0.3 to 1.5% of manganese, 0.1 to 2% of chromium, 0.5 to 1.5% of silicon, 1 to 5% of nickel, 0.2 to 1% of molybdenum, less than 0.015% of phosphorus and less than 0.005% of sulphur, the remainder being iron and residual impurities resulting from the smelting of the materials necessary for the production.

The invention also relates to a process for the production of such a steel.

5 Claims, 1 Drawing Sheet

HIGH HARDNESS STEEL FOR ARMOURING AND PROCESS FOR THE PRODUCTION OF SUCH A STEEL

The present invention relates to a high-hardness steel for armouring, super-armouring and a super-protection shutter, usable in the form of sheet metal and/or parts and having a high ballistic performance.

The present invention also relates to a process for the production of such a steel.

Steels for armouring are known, such as, for example 28 NCD6 steel, the composition, by weight, of which is:
carbon: 0.28%
nickel: 1.6%
chromium: 1.6%
molybdenum: 0.3%
or 50 CDV5 steel, the composition, by weight, of which is:
carbon : 0.5%
chromium : 5%
molybdenum : 1.3%
vanadium : 0.45%

The aim of the invention is to improve the ballistic resistance properties of monobloc armouring.

In fact, the increase in the hardness allows the steels better to resist the impact of a projectile, the steel becoming capable of shattering the projectile. However, the increase in the hardness can give rise to a reduction in the impact strength, that is to say an increase in fragility.

The subject of the invention is a steel combining a hardness comparable and even superior to the currently known steels with an impact strength which nevertheless remains high.

The steel according to the present invention is characterized in that its composition, by weight, is as follows:
0.4 to 0.7% of carbon
0.3 to 1.5% of manganese
0.1 to 2% of chromium
0.5 to 1.5% of silicon
1 to 5% of nickel
0.2 to 1% of molybdenum
less than 0.015% of phosphorus
less than 0.005% of sulphur
the remainder being iron and residual impurities resulting from the smelting of the materials necessary for the production.

The presence of carburigenic elements such as carbon, chromium, manganese and molybdenum in the composition enables high levels of hardness to be ensured.

The nickel content is set so as to ensure a good hardenability and to enable a steel of high impact strength to be obtained.

The sulphur content is preferably lower than 0.002% in order to improve the impact strength.

The present invention also relates to a process for the production of a high-hardness steel, characterized in that the steel is subjected:
- to hot-rolling, for shaping, at a temperature of between 1,000° and 1,300° C.,
- to quenching in a press,
- and to hardening carried out at a temperature of between 150° and 250° C.

Preferably, the hot-rolling is carried out at a temperature of between 1,150° and 1,250° C. using a forging ratio higher than 2. The quenching in a press which prevents significant deformation of the sheet metal, is carried out after heating to a temperature of between 800° and 960° C.

The invention also relates to armouring obtained by this process.

According to other characteristics of the invention:
- the armouring consists of a sheet of high-hardness steel pierced by regularly distributed orifices and having 30 to 60% of void relative to the total volume.
- the armouring consists of a sheet of high-hardness steel covered with an elastomer,
- the elastomer is mixed with synthetic fibres.

The invention also relates to a ballistic super-protection shutter for the glass of the windows or windscreen of armoured vehicles, produced with steel armouring according to the invention.

The super-protection shutter permits acceptable visibility and ensures effective ballistic protection.

The invention will be better understood with the aid of the description which follows, which is given solely by way of example and with reference to the appended drawings, on which:

Figure 1:
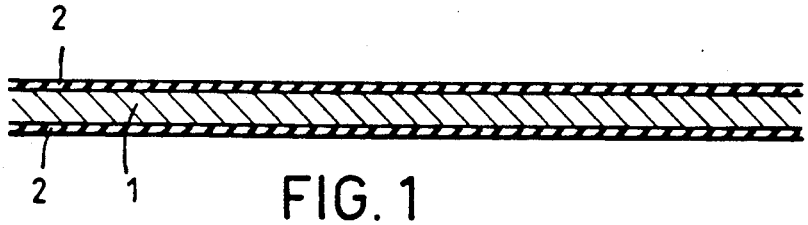
FIG. 1 is a sectional view of a sheet steel for armouring according to the invention.

The high-hardness steel according to the invention for armouring, can preferably be used in the form of sheet metal for ballistic protection. The rolled and treated sheet steel has a high ballistic performance.

An example of the composition of the steel according to the invention is given, in proportions by weight, in Table I:

| | Elements | | | | | | | |
|---|---|---|---|---|---|---|---|---|
| | C | Si | Mn | Ni | Cr | Mo | S | P |
| Proportion % | 0.5 | 0.8 | 0.5 | 1.9 | 0.2 | 0.4 | 0.007 | 0.004 |

The carbon content of 0.5% enables a very high degree of hardness to be obtained after quenching. However, to obtain a good impact resistance, the sulphur content must be as low as possible.

In order to obtain the armouring properties, the steel produced is subjected to hot-rolling. The heating temperature before rolling is between 1,000° and 1,300° C. and preferably between 1,150° and 1,250° C., the forging ratio being higher than 2.

After production of sheet metal, 7 mm in thickness for example, said sheet metal is subjected to an oil-quench heat treatment. It is kept in a press during the quenching operation in order to obtain an inherent flatness of about 3 mm/m, the austenization temperature being 850° C. The quenching is followed by hardening at a temperature of between 150° and 250° C. and preferably equal to 220° C.

The mechanical properties of the sheet metal produced and treated as described above are compared with the 28 NCD6 and 50 CDV5 steels and collated in Table II below:

| Steel | Hardness BH | Tensile Rm (MPa) | Re (MPa) 02% | A % (5d) | Impact strength J/cm² +20° C. | −40° C. |
|---|---|---|---|---|---|---|
| 28NCD6 | 500 | 1750 | 1350 | 13 | 45 | 40 |
| 50CDV5 | 620 | 2200 | 1700 | 5 | 4 | 4 |
| Steel according to the invention | 625 | 2270 | 1710 | 4.5 | 15 | 12 |

The mechanical properties measured for the sheet metals are the Brinell hardness BH, the tensile properties of the steel, elastic limit Re, ultimate tensile stress Rm and the elongation at break A, as well as its impact properties at two set temperatures (+20° C. and −40° C.).

Comparing the values given in Table II, it is found that the steel according to the invention has a better impact strength than the 50 CDV 5 steel with a comparable hardness.

The steel according to the invention has better properties in respect of elasticity and in respect of hardness than the 28 NCD6 steel with a comparable impact strength.

Moreover, the steel according to the invention can be cut by the plasma process, gas cutting or by laser, taking precautions suitable for the various sheet metal thicknesses.

In order to optimize the ballistic performance of the sheet metal subjected to impacts by projectiles, the said sheet metal, after rolling, is pierced with orifices. The holes have, for example, a diameter of between 3 and 15 mm. The sheet metal pierced with orifices is then quenched and then subjected to hardening under the conditions previously described.

When used for super-armouring, the aim of the perforated and treated sheet metal is to shatter the core of the projectile, or cause it to splinter, without immediate deterioration of the said super-armouring.

The surface mass of the perforated sheet metal is reduced in the ratio of the total surface area of the orifices to the total surface area of the sheet metal before piercing, the sheet metal being able to have from 30 to 60% reduction in weight for an identical ballistic protection efficiency. The orifices improve the resistance to cracking at the moment of impact.

In order to improve the ballistic resistance in another way, the armouring is formed from solid sheet metal 1 (FIG. 1) according to the invention, covered on one of its faces or on both of its faces with a synthetic material 2, such as, for example, an elastomer, which can be reinforced by mixing it with a synthetic fibre.

The armouring according to the invention has a high ballistic performance, in particular against piercing projectiles from 5.56 mm, 7.62 mm and 12.7 mm calibre weapons.

When used as super-armouring sheet metal, the steel according to the invention is able to resist, in particular, piercing projectiles from 12.7 mm, 14.5 mm and 20 mm calibre weapons.

Its toughness, that is to say its resistance to several successive impacts, is improved by piercing with orifices and/or by coating with a synthetic material.

The invention finds its application in particular in super-armouring, placed in front of armouring of already existing structure, said super-armouring allowing the projectile to be shattered and its piercing power thus to be reduced.

The invention also finds its application in a ballistic super-protection shutter for the windows or windscreen of lightweight armoured vehicles.

Figure 2:
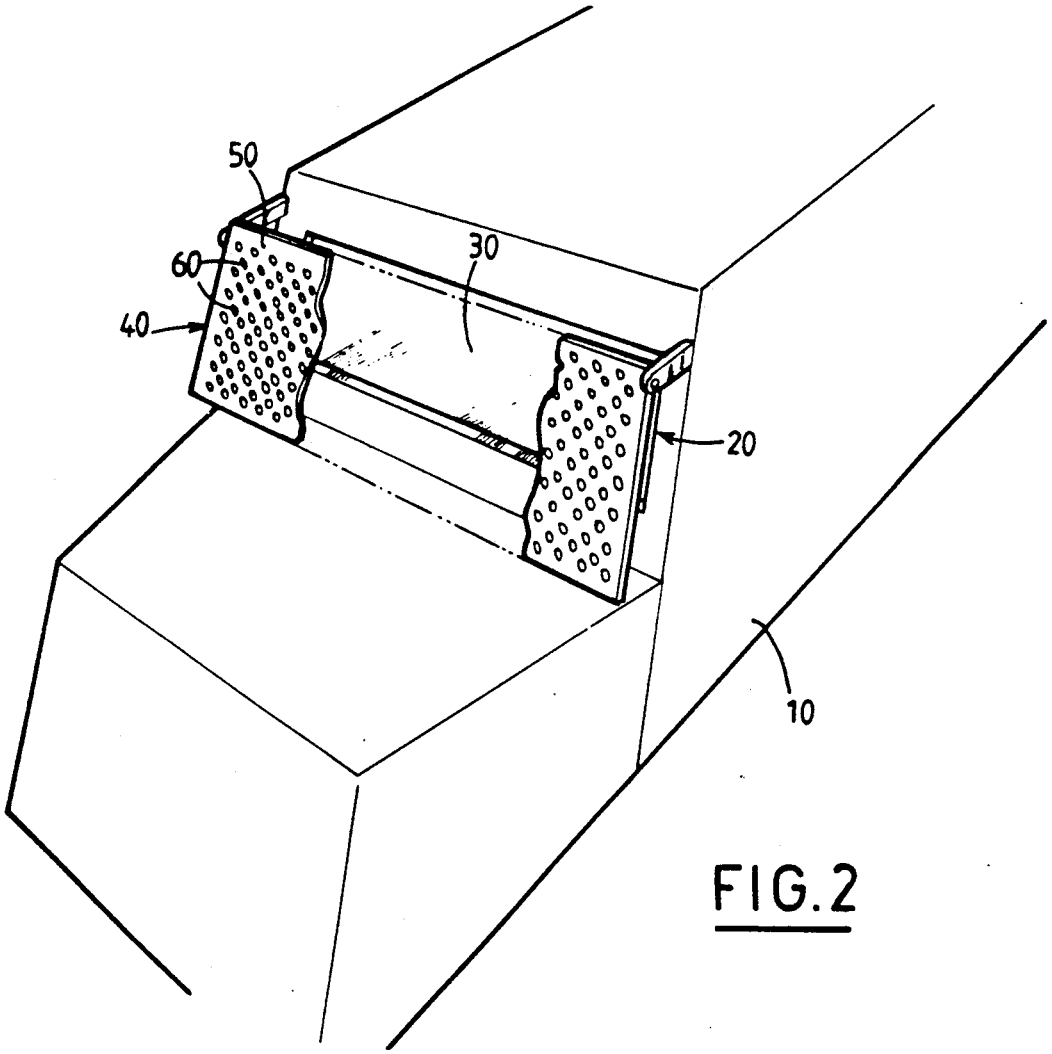
FIG. 2 is a partial perspective view of an armoured vehicle fitted with an super-protection shutter according to the invention.

The front part of a lightweight armoured vehicle consisting of a shell 10 has been shown schematically in FIG. 2.

The shell 10 contains openings and in particular, at the front, an opening 20 fitted with lightly armoured glass 30 and allowing the driver to have good visibility and thus be able to drive the vehicle.

In order to improve the ballistic protection of each window, and in particular of the windscreen glass 30, the vehicle is fitted with shutters 40 which can be lowered and are formed from an armouring 50 made of steel of very high hardness according to the invention.

The armouring 50 is pierced by a multitude of small orifices 60 which are regularly distributed and represent a void of 30 to 60% relative to the surface area of the said plate.

The orifices 60 have a diameter smaller than the smallest calibre against which the windscreen provides no protection on its own, and the shutter 40, with the glass 30, provides an empty space. This arrangement allows a super-protection of the windows or windscreen of the vehicle to be obtained while ensuring visibility by virtue of the large number of small orifices 60.

Moreover, the shutter 40 shatters or reduces the speed of the projectiles, especially piercing projectiles, which allows the decelerated projectiles or the shower of splinters passing through the shutter to be stopped by the armoured windscreen.

We claim:

1. High-hardness steel for armouring usable in the form of metal sheets and/or parts and having a high ballistic performance, wherein its composition, by weight, is as follows:

0.4 to 0.7% of carbon
0.3 to 1.5% of manganese
0.1 to 2% of chromium
0.5 to 1.5% of silicon
1 to 5% of nickel
0.2 to 1% of molybdenum
less than 0.015% of phosphorus
less than 0.005% of sulphur the remainder being iron and residual impurities resulting from the smelting of the materials necessary for the production.

2. High-hardness steel according to claim 1, wherein the sulphur content is less than 0.002%.

3. Process for the production of a high-hardness steel according to claim 1, wherein the steel is subjected:

to hot-rolling at a temperature of between 1,000° and 1,300° C., then
to quenching in a press,
and to hardening carried out at a temperature of between 150° and 250° C.

4. Process according to claim 3, characterized in that the hot-rolling is carried out at a temperature of between 1,150° and 1,250° C. using a forging ratio higher than 2.

5. Process according to claim 3, wherein the quenching is carried out after heating to a temperature of between 800° and 960° C.

* * * * *